US005366691A

United States Patent [19]

Takeda et al.

[11] Patent Number: 5,366,691

[45] Date of Patent: Nov. 22, 1994

[54] HYPER-EUTECTIC ALUMINUM-SILICON ALLOY POWDER AND METHOD OF PREPARING THE SAME

[75] Inventors: Yoshinobu Takeda; Tetsuya Hayashi; Toshihiko Kaji; Yusuke Odani; Kiyoaki Akechi, all of Hyogo; Jun Kusui, Osaka; Takamasa Yokote, Osaka; Akiei Tanaka, Osaka; Takashi Watsuji, Osaka, all of Japan

[73] Assignees: Sumitomo Electric Industries, Ltd.; Toyo Aluminum K.K., both of Osaka, Japan

[21] Appl. No.: 863,285

[22] PCT Filed: Oct. 31, 1991

[86] PCT No.: PCT/JP91/01488

§ 371 Date: Jun. 24, 1992

§ 102(e) Date: Jun. 24, 1992

[87] PCT Pub. No.: WO92/07676

PCT Pub. Date: May 14, 1992

[30] Foreign Application Priority Data

Oct. 31, 1990 [JP] Japan ..... 2-295018
Oct. 31, 1990 [JP] Japan ..... 2-295019
Oct. 31, 1990 [JP] Japan ..... 2-295099

[51] Int. Cl.[5] ..... C22C 21/00
[52] U.S. Cl. ..... 420/548; 420/534
[58] Field of Search ..... 420/548, 534

[56] References Cited

U.S. PATENT DOCUMENTS 3,532,775 10/1970 Brondyke et al. ..... 75/338
3,899,820 8/1975 Read et al. ..... 75/338
3,953,202 4/1976 Rasmussen ..... 420/548
4,113,473 9/1978 Gauvry ..... 420/548
4,592,781 6/1986 Cheney et al. ..... 75/343
4,669,019 5/1987 Kuroda ..... 420/548
4,808,375 2/1989 Ivchenkov et al. ..... 420/548
5,009,844 4/1991 Laxmanan ..... 420/548

FOREIGN PATENT DOCUMENTS 45-1538 1/1970 Japan .
59-37339 9/1984 Japan .
63-266004 11/1988 Japan .
1-147038 6/1989 Japan .
2-213401 8/1990 Japan .
1000323 8/1965 United Kingdom ..... 420/548
0467945 4/1975 U.S.S.R. ..... 420/548

OTHER PUBLICATIONS

Article Entitled: "Hypereutectic Aluminum-Silicon Alloys Produced by Powder Metallurgy Techniques" by C. F. Dixon et al.; International Journal of Powder Metallurgy, 1 (4), 1965, (pp. 28-36).

*Primary Examiner*—Upendra Roy
*Attorney, Agent, or Firm*—W. G. Fasse; W. F. Fasse

[57] ABSTRACT

A hyper-eutectic aluminum-silicon powder containing extremely fine primary crystal silicon, is prepared by atomizing. First, a molten metal of a hyper-eutectic aluminum-silicon alloy containing phosphorus is prepared. This molten metal or melt is atomized with air or an inert gas and quench-solidified. Aluminum-silicon alloy powder containing primary crystal silicon of not more than 10 μm in crystal grain size is obtained. This aluminum-silicon alloy powder contains at least 12 percent by weight and not more than 50 percent by weight of silicon and at least 0.0005 percent by weight and not more than 0.1 percent by weight of phosphorus. When this hyper-eutectic aluminum-silicon alloy powder is employed, it is possible to prepare a consolidate of powder which has improved mechanical properties, and provides a high yield.

14 Claims, 3 Drawing Sheets

HYPER-EUTECTIC ALUMINUM-SILICON ALLOY POWDER AND METHOD OF PREPARING THE SAME

FIELD OF THE INVENTION

The present invention relates to hyper-eutectic aluminum-silicon alloy powder and a method of preparing the same. More particularly, the invention relates to hyper-eutectic aluminum-silicon alloy powder which stably contains fine silicon primary crystals. The invention also relates to a method of preparing such a powder.

BACKGROUND INFORMATION

When silicon (Si) is added to aluminum (Al), remarkable effects are attained for reducing the thermal expansion coefficient, increasing the Young's modulus, improving the wear resistance, and the like. Al-Si alloys utilizing such effects have already been widely used.

Among such Al-Si alloys, a cast material is classified as AC or ADC under the Japanese Industrial Standards, and widely used as an aluminum alloy for casting for example engine blocks. An Al-Si alloy prepared as an wrought material is classified in the 4,000 series, and worked into various parts by extrusion, forging or the like starting with a cast billet.

It is well known that a hyper-eutectic Al-Si alloy has been prepared by a casting method. A hyper-eutectic Al-Si alloy casting obtained by the casting method, which has excellent properties such as a low thermal expansion coefficient, a high Young's modulus and a high wear resistance, is expected to be used in various fields. When such a hyper-eutectic Al-Si alloy casting contains coarse primary crystals of silicon, however, its mechanical properties and machinability are deteriorated.

It is also well known that a refiner, particularly phosphorus (P), may be added in order to refine the primary crystals of silicon contained in a hyper-eutectic Al-Si alloy casting. Even if such a refiner is added when a hyper-eutectic Al-Si alloy is cast, however, the refinement of silicon primary crystals is restricted. Particularly when the Al-Si alloy contains silicon in excess of 20 percent by weight, coarse primary crystals of silicon still remain even if the refiner is added, and hence the mechanical properties and machinability of the alloy are still deteriorated.

In recent years, on the other hand, it is possible to prepare powder from a molten metal at a high cooling rate, which has been unavailable in a casting method, by a method of preparing a rapidly solidified powder, such as by atomizing. Therefore, primary crystals of silicon can be so refined that it is possible to prepare a hyper-eutectic Al-Si alloy powder containing silicon in excess of an eutectic composition and further containing a transition metal element X such as iron (Fe), nickel (Ni), chromium (Cr), manganese (Mn) or the like as a third alloy component. Powder metallurgical alloys such as Al-17Si-X, Al-20Si-X and Al-25Si-X, having properties even superior to those of cast alloys of this type have been put into practice as alloys prepared by a powder metallurgical method using such powder materials.

In order to further improve the mechanical properties of the aforementioned powder metallurgical alloys, it is necessary to further refine the crystals of silicon while simultaneously homogenizing the crystal grain sizes of silicon. Further, it is extremely important to reduce the presence of coarse crystals of silicon, which serve as starting points of rupture even if the amount thereof is small to cause a reduction in the material strength. In addition, such primary crystals of silicon contained in the powder can hardly be refined by hot solidification such as forging or extrusion, but rather become coarse due to Ostwald growth. Thus, the sizes of the silicon primary crystals contained in the alloy powder are definitely important.

It is known that a cooling rate in the preparation of the powder may be increased in order to refine primary crystals of silicon. However, such a cooling rate is generally obtained by a method of and an apparatus for atomizing, and no other industrial method of increasing such a cooling rate has been implemented due to economic problems especially a low productivity.

In the conventional atomizing method, the particle sizes of silicon primary crystals contained in the entire powder volume are extremely dispersed so far as the obtained powder has a particle size distribution of a constant width, since the cooling rate depends on the particle size of the powder. For example, powder of about 400 μm in particle size has generally unavoidably contained coarse silicon primary crystals of about 20 μm in particle size.

To this end, coarse powder having a low cooling rate has generally been removed by sieving or sifting in order to eliminate particles of coarse silicon primary crystals, thereby preparing consolidates including only fine powder particles. According to the known method, however, the material yield is reduced, making the known method economically unattractive. Further, the flowability of the; compactibility of the powder is substantially reduced and there is an increased danger of a dust explosion.

SUMMARY OF THE INVENTION

In consideration of the aforementioned circumstances of the prior art, it is an object of the present invention to provide a composition of a hyper-eutectic Al-Si alloy powder containing fine and homogeneous primary crystals of silicon which is capable of suppressing primary crystallization of coarse primary crystals of silicon, in particular by atomizing, and a method of preparing the same.

The inventors have found that hyper-eutectic aluminum-silicon alloy powder containing extremely fine primary crystal silicon can be obtained by atomizing a molten metal of an aluminum-silicon alloy to which a primary crystal silicon refiner containing phosphorus is added, or an alloy molten metal is obtained by melting an aluminum-silicon alloy ingot into which a primary crystal silicon refiner containing phosphorus has been introduced when producing the ingot. The atomizing is performed with air or an inert gas.

Hyper-eutectic aluminum-silicon alloy powder in accordance with a first aspect of the present invention contains at least 12 percent by weight and not more than 50 percent by weight of silicon, and at least 0.0005 percent by weight and not more than 0.1 percent by weight of phosphorus.

The particle size of primary crystal silicon contained in the present hyper-eutectic aluminum-silicon alloy powder is by far smaller than the size of primary crystal silicon contained in a conventional hyper-eutectic aluminum-silicon alloy obtained by a casting method, and is not more than 10 μm on average.

The preferred content of silicon in the present aluminum-silicon alloy powder within the above stated wider range is at least 20 percent by weight and not more than 30 percent by weight. If the content of silicon is less than 12 percent by weight, no primary crystal silicon is formed. If the content of silicon exceeds 50 percent by weight, on the other hand, the amount of primary crystal silicon is too much however primary crystals of silicon are refined. Nevertheless, consolidates made of the obtained powder are inferior in machinability and its mechanical strength is deteriorated.

The preferred content of phosphorus in the present aluminum-silicon alloy powder within the above stated wider range is at least 0.0005 percent by weight and not more than 0.05 percent by weight. If the content of phosphorus is less than 0.0005 percent by weight, no effect of refinement is attained and no improvement of mechanical strength is recognized. On the other hand, the effect of refinement is not further improved even if the content of phosphorus exceeds 0.1 percent by weight. Aluminum-silicon alloy powder containing at least 0.02 percent by weight and not more than 0.1 percent by weight of phosphorus has a particularly excellent machinability.

A preferred aluminum-silicon alloy powder according to the present invention contains at least 12 percent by weight and not more than 50 percent by weight of silicon, at least 2.0 percent by weight and not more than 3.0 percent by weight of copper, at least 0.5 percent by weight and not more than 1.5 percent by weight of magnesium, at least 0.2 percent by weight and not more than 0.8 percent by weight of manganese, and at least 0.0005 percent by weight and not more than 0.05 percent by weight of phosphorus, the remainder being aluminum and unavoidable impurities. Aluminum-silicon alloy powder containing the respective elements of copper, magnesium and manganese has a high mechanical strength.

According to a method of preparing hyper-eutectic aluminum-silicon alloy powder in accordance with a second aspect of the present invention, a molten metal of a hyper-eutectic aluminum-silicon alloy containing phosphorus is first prepared. The molten metal is atomized with air or an inert gas, and quench-solidified.

The molten metal of a hyper-eutectic aluminum-silicon alloy containing phosphorus may be made of a molten metal of an aluminum-silicon alloy to which a primary crystal silicon refiner containing phosphorus has been added, or it may be made of an alloy molten metal obtained by melting an aluminum-silicon alloy ingot including a primary crystal silicon refiner containing phosphorus which was added when making the ingot.

In the present preparation method, the primary crystal silicon refiner containing phosphorus is made of a primary crystal silicon refiner employed in a conventional casting method, such as Cu-8 wt. % P, Cu-15 wt. % P, $PCl_5$ or mixed salt mainly composed of red phosphorus, or an Al-Cu-P refiner.

In the present preparation method, the aluminum-silicon alloy molten metal is atomized according to a well-known method.

In the preparation method according to the present invention, the alloy molten metal is preferably atomized when the melt is at a temperature exceeding the liquidus temperature of the aluminum-silicon alloy by at least 100° C. and not more than 1300° C. When the primary crystal silicon refiner is added to the aluminum-silicon alloy melt the alloy melt is preferably held at the aforementioned temperature.

The term "liquidus temperature" indicates a temperature at which the alloy of the composition is completely molten. For example, the liquidus temperature of an aluminum-silicon alloy containing 25 percent by weight of silicon is about 780° C.

When the alloy molten metal is held at a temperature lower than the liquidus temperature of the aluminum-silicon alloy+100° C., the phosphorus is insufficiently melted so that the amount of phosphorus contained in the alloy is reduced as compared with the amount of the added phosphorus, and hence it is difficult to obtain an alloy powder containing phosphorus in the correct amount. If the alloy molten metal is held at a temperature exceeding 1300° C., on the other hand, a crucible and a furnace material are damaged to such an extent that the alloy elements contained in the crucible may be partially evaporated and it may be impossible to obtain an alloy having the desired composition.

More preferably, the alloy molten metal is held at the proper temperature as stated above for at least for 30 minutes, and thereafter atomized. When the holding time is shorter than 30 minutes, phosphorus is so insufficiently melted that the amount of phosphorus contained in the alloy is reduced as compared with the amount of the added phosphorus, and it is difficult to obtain an alloy powder containing phosphorus in the correct amount. However, this holding time does not apply when using an Al-Cu-P inoculant or refiner in which case the holding time may be shorter than 30 minutes.

An aluminum-silicon alloy to which the present method is applied, is not particularly restricted but can also include a general aluminum-silicon alloy containing elements other than aluminum and silicon, such as copper, magnesium, manganese, iron, nickel, zinc and the like. The present powder production method is particularly useful for an aluminum-silicon alloy having a high content of at least 20 percent by weight and not more than 40 percent by weight of silicon.

Thus, according to the present invention, it is possible to obtain hyper-eutectic aluminum-silicon alloy powder in which extremely fine primary crystal silicon is homogeneously dispersed throughout the volume. The preparation or powder production under the aforementioned preferred conditions, makes it is possible to obtain hyper-eutectic aluminum-silicon alloy powder having the desired composition.

Consolidates prepared from the present hyper-eutectic aluminum-silicon alloy powder have a rather superior machinability and respective mechanical properties.

According to a method of preparing hyper-eutectic aluminum-silicon alloy powder in accordance with a third aspect of the present invention, a molten metal of a hyper-eutectic aluminum-silicon alloy containing phosphorus is first prepared. This molten metal is atomized with air and quench-solidified, thereby preparing hyper-eutectic aluminum-silicon alloy powder. Only alloy powder of not more than 400 μm in particle size is selected, e.g. by sifting.

In the present method, an inoculation method, which has been employed in a casting method is applied, to first inoculate with phosphorus a hyper-eutectic aluminum-silicon alloy molten metal for atomizing.

It is possible to first prepare nuclei in solidification thereby suppressing heterogeneous nucleation caused by supercooling, by inoculating a homogeneously melted alloy molten metal with phosphorus and dispersing the phosphorus in the melt. The inoculated phosphorus must be homogeneously dispersed in the molten metal as solid particulates at the atomizing temperature. At the same time, it is necessary to eliminate unmelted or solid components other than phosphorus from the molten metal, since such solid components easily form coarse crystallized substances. The inoculated molten metal can be temporarily cooled and solidified and thereafter again melted to be returned to the original state of the inoculated molten metal.

Then, the inoculated molten metal is atomized by air atomizing, and quench-solidified. The air atomizing is employed as the method for preparing powder by quench solidification, since this method is more economic as compared with other methods and the powder can be easily handled since its surface is stabilized by suitable oxidation.

Regarding the conditions for quench solidification, it is known that the structure is more refined as the cooling rate is increased. In the preparation method according to the present invention, however, a large number of crystallized nuclei of silicon primary crystals are first introduced into the molten metal, so that the maximum crystal grain size of primary crystal silicon can be regularly controlled in a fine and narrow range with respect to the particle size of the obtained powder without strongly depending on the cooling rate, which is difficult to control. Namely, it is possible to obtain fine and relatively homogeneous primary crystals of silicon even at a slower cooling rate whereby the particle size of the obtained powder is relatively large, as compared with the conventional atomizing method.

When the particle size of the obtained alloy powder is selected to be not more than 400 μm, the maximum crystal grain size of the primary crystal silicon is controlled to be not more than 10 μm. Preferably, the maximum crystal grain size of the primary crystal silicon is controlled to be not more than 7 μm if the particle size of the obtained alloy powder is selected to be not more than 200 μm. More preferably, the maximum crystal grain size of the primary crystal silicon is controlled to be not more than 5 μm, if the particle size of the obtained alloy powder is selected to be not more than 100 μm. Further, the maximum crystal grain size of the primary crystal silicon is controlled to be not more than 3 μm, if the particle size of the as-obtained alloy powder is selected to be not more than 50 μm.

In order to consistently obtain the aforementioned working effect, the concentration of the inoculated phosphorus is preferably in the range of at least 0.005 percent by weight and not more than 0.02 percent by weight.

According to the third aspect of the present invention, as hereinabove described, it is possible to refine and homogenize primary crystal silicon contained in hyper-eutectic aluminum-silicon alloy powder prepared by atomizing, and to remarkably reduce the dependency of the particle size of the primary crystal silicon on the grain size of the alloy powder as compared with the prior art. Consequently, it is possible to prepare consolidates of powder which have more improved mechanical properties as compared with the prior art. A high yield is also obtained by employing the hyper-eutectic aluminum-silicon alloy powder.

DETAILED DESCRIPTION OF PREFERRED EXAMPLE EMBODIMENTS AND OF THE BEST MODE FOR CARRYING OUT THE INVENTION

Example 1

Molten metals of aluminum alloys having compositions shown in Table 1 were held in a melt at a temperature of 950° C., and Cu-8 wt. % P was added to the melt to obtain the phosphorus contents shown in Table 1. The molten metals were held at the temperature of 950° C. for 1 hour, and then powdered by air atomizing refer to alloy powder samples No. 1 to No. 4 in Table 1.

Figure 1:
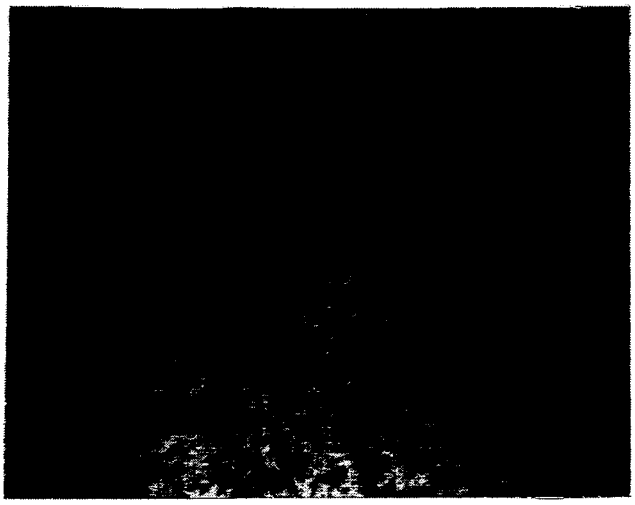
FIG. 1 is an optical micrograph, showing the microstructure of primary crystal silicon contained in aluminum alloy powder according to Example 1, magnification: ×400.

The obtained alloy powder samples were classified by sieves having a mesh size of −42 to −80 meshes yielding particle sizes of 175 to 350 μm, and thereafter sizes of primary crystal silicon particles contained in the powder samples were measured by structure observation with an optical microscope. The results are shown in Table 1. FIG. 1 shows a structure photograph of the alloy powder No. 1 through an optical microscope.

Comparative Example 1

Alloy powder No. 5 was prepared under the same conditions as the alloy powder No. 1. In this case, however, no Cu-8 wt. % P was added to the molten metal or melt of the aluminum alloy.

Figure 2:
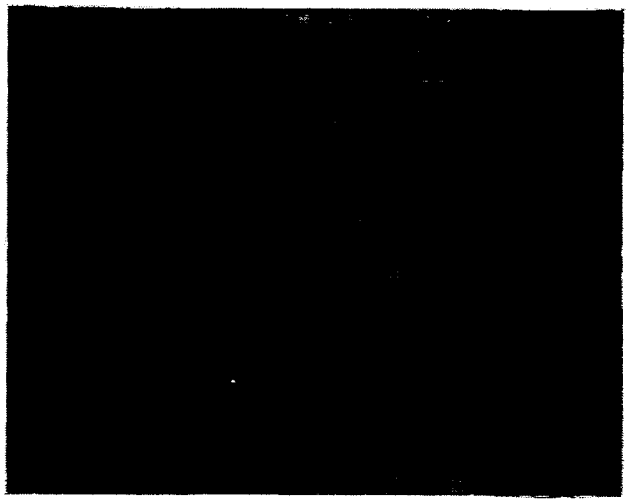
FIG. 2 is an optical micrograph showing the microstructure of primary crystal silicon contained in aluminum alloy powder obtained according to Comparative Example 1, magnification: ×400.

The obtained alloy powder was classified by sieves of −42 to −80 meshes yielding particle sizes of 175 to 350 μm. Thereafter sizes of primary crystal silicon particles contained in the powder were measured through structure observation with an optical microscope. The results are shown in Table 1. FIG. 2 shows a structure photograph of the alloy powder No. 5 through an optical microscope.

Comparative Example 1A

A molten metal of an aluminum alloy having the same composition as the alloy powder No. 1 was held at a temperature of 950° C., and Cu-8 wt. % P was added to obtain the content of phosphorus shown in Table 1. This molten metal was held at the temperature of 950° C. for 1 hour, and thereafter cast in a metal mold of 30 mm in diameter by 80 mm high, to prepare an alloy casting (No. 6).

Figure 3:
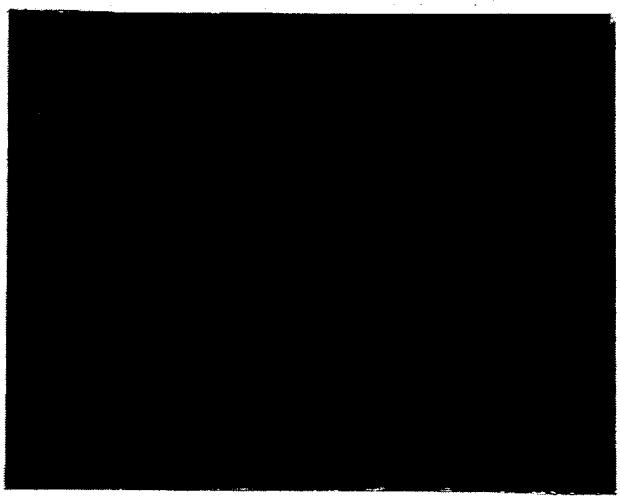
FIG. 3 is an optical micrograph, showing the structure of primary crystal silicon contained in an aluminum cast alloy, magnification: ×400.

Sizes of primary crystal silicon particles contained in the obtained alloy casting were measured through micro-structure observation with an optical microscope. The results are shown in Table 1. FIG. 3 shows a structure photograph of the alloy casting through an optical microscope.

Comparing the structure photographs shown in FIGS. 1 to 3 through an optical microscope, it is clearly understood that the primary crystal silicon particles contained in the alloy powder samples obtained according to the present method are finely and homogeneously dispersed as compared with those contained in the alloy powder sample of the same composition obtained according to Comparative Example 1, containing no phosphorus.

TABLE 1

| | Alloy No. | Composition (wt. %) Si | Cu | Mg | Mn | P | Particle Size of Si Primary Crystal (μm) |
|---|---|---|---|---|---|---|---|
| Example 1 | 1 | 25 | 2.5 | 1.0 | 0.5 | 0.0240 | 1–5 |
| | 2 | 25 | 3.5 | 0.5 | 0.5 | 0.0055 | 1–6 |
| | 3 | 25 | 3.5 | 1.0 | 0.0 | 0.0545 | 1–5 |
| | 4 | 25 | 2.5 | 1.5 | 0.5 | 0.0125 | 1–5 |
| Comparative Example 1 | 5 | 25 | 2.5 | 1.0 | 0.5 | <0.0005 | 3–20 |
| Comparative Example 1A | 6 | 25 | 2.5 | 1.0 | 0.5 | 0.0240 | 5–80 |

Compacts prepared from the alloy powder and alloy casting samples obtained in the aforementioned Example and Comparative Examples were subjected to a machinability test.

The alloy powder samples No. 1 and No. 5 obtained in Example 1 and Comparative Example 1 were classified by −42 mesh sizes yielding particle sizes of not more than 350 μm, and cold-preformed as compacts having a size of 30 mm diameter by 80 mm high at a pressure of 3 ton/cm$^2$. Thereafter these consolidated compacts were hot worked into round bars of 10 mm in diameter at an extrusion temperature of 450° C. at an extrusion ratio of 10. The alloy casting sample No. 6 obtained in Comparative Example 1A was also extruded into a round bar of 10 mm in diameter in a similar manner.

The extruded round bars obtained in the aforementioned manner were cut with a cemented carbide tool at a cutting speed of 100 m/min. in a cutting operation, to measure amounts of wear of the tools after cutting for 10 minutes. The results are shown in Table 2.

TABLE 2

| | Amount of Tool Wear (mm) |
|---|---|
| Example 1 (Alloy No. 1) | 0.03 |
| Comparative Example 1 (Alloy No. 5) | 0.12 |
| Comparative Example 1A (Alloy No. 6) | 1.01 |

It is clearly understood from the results shown in Table 2 that the machinability of the hot worked product made of the present alloy powder is remarkably excellent.

Example 2

As shown in Table 3, molten metals obtained by melting aluminum alloy ingots containing phosphorus were held at a temperature of 950° C. for 1 hour. Thereafter these molten metals or rather the melt was powdered by air atomizing, refer to alloy powder samples No. 11 to No. 15 in Table 3.

The obtained alloy powder samples were classified by a −100 mesh size yielding particle sizes of not more than 147 μm, and thereafter sizes of primary crystal silicon particles contained in the powder samples were measured through structure observation with an optical microscope. The results are shown in Table 3.

Comparative Example 2

Alloy powder samples No. 16 to No. 18 were prepared under the same conditions as the alloy powder samples No. 11 to No. 15. In this case, however, aluminum alloy ingots containing no phosphorus were employed.

The obtained alloy powder samples were classified by a −100 mesh size yielding particle sizes of not more than 147 μm, and sizes of primary crystal silicon particles contained in the powder samples were measured through micro-structure observation with an optical microscope. The results are shown in Table 3.

TABLE 3

| | Alloy No. | Composition (wt. %) Si | Cu | Mg | Mn | P | Particle Size of Si Primary Crystal (μm) |
|---|---|---|---|---|---|---|---|
| Example 2 | 11 | 25 | 2.5 | 1.0 | 0.5 | 0.0041 | 1–10 |
| | 12 | 25 | 2.5 | 1.0 | 0.5 | 0.0116 | 1–10 |
| | 13 | 25 | 2.5 | 1.0 | 0.0 | 0.0395 | 1–5 |
| | 14 | 25 | 3.5 | 2.0 | 0.5 | 0.0075 | 1–10 |
| | 15 | 25 | 2.5 | 1.0 | 0.0 | 0.0152 | 1–10 |
| Comparative Example 2 | 16 | 25 | 2.5 | 1.0 | 0.5 | <0.0005 | 1–20 |
| | 17 | 25 | 3.5 | 2.0 | 0.5 | <0.0005 | 1–20 |
| | 18 | 25 | 2.5 | 1.0 | 0.0 | <0.0005 | 1–20 |

The alloy powder samples obtained in the aforementioned Example 2 and Comparative Example 2 were subjected to a transverse rupture strength test.

The alloy powder samples No. 11 to No. 18 obtained in Example 2 and Comparative Example 2 were classified by a 100 mesh size yielding particle sizes of not more than 147 μm, and thereafter cold-preformed into compacts having a size of 30 mm diameter by 80 mm high at a pressure of 3 ton/cm$^2$. Thereafter these consolidated compacts were hot worked into flat plates of 20 mm by 4 mm thick at an extrusion temperature of 450° C. at an extrusion ratio of 10. The flat plate extruded materials obtained in the above manner were T6 treated, and thereafter subjected to measurement of transverse rupture strength on the basis of JISZ2203 with a gauge length of 30 mm. The results are shown in Table 4.

TABLE 4

| | Alloy Powder | Transverse Rupture Strength (kg/mm$^2$) |
|---|---|---|
| Example | No. 11 | 79.9 |
| | 12 | 80.3 |

TABLE 4-continued

| | Alloy Powder | Transverse Rupture Strength (kg/mm²) |
|---|---|---|
| | 13 | 67.0 |
| | 14 | 73.1 |
| | 15 | 71.6 |
| Comparative Example | 16 | 72.2 |
| | 17 | 66.9 |
| | 18 | 65.0 |

It is clearly understood from the results shown in Table 4 that the transverse rupture strength levels of the present alloy powder samples containing phosphorus are higher than those of the alloy powder samples containing no phosphorus, by about 10 percent. Further, the present alloy powder sample No. 13 with a content of phosphorus exceeding 0.02 percent by weight is sufficiently usable although its transverse rupture strength is slightly reduced as compared with the comparative alloy powder sample No. 16.

Example 3

The following hyper-eutectic aluminum-silicon alloys were prepared from ingots:

A-17: 2024 ingot+17 wt. % Si
A-20: 2024 ingot+20 wt. % Si
A-25: 2024 ingot+25 wt. % Si
B-25: 2024 ingot+25 wt. % Si+5 wt. % Fe
C-25: 2024 ingot+25 wt. % Si+5 wt. % Fe+2 wt. % Ni
D-25: Al+25 wt. % Si+2.5 wt. % Cu+1 wt. % Mg+0.5 wt. % Fe+0.5 wt. % Mn
E-25: Al ingot of 99.9 % purity+25 wt. % Si Molten metals of the aforementioned respective alloys were inoculated with phosphorus at the rates shown in Table 5 or inoculated with no phosphorus, atomized under conditions of air pressures of 5 to 10 kg/mm² by open air atomizing, and quench-solidified.

The obtained alloy powder samples were continuously collected, classified with air, and further classified through a sieve. Table 5 shows the relationship between powder grain sizes $D_p$ and the maximum particle sizes $D_{si}$ of Si primary crystals as the results of selecting the particle sizes of the silicon primary crystals contained in these alloy powder samples with a image analysis microscope.

TABLE 5

| Powder Grain Size $D_P$ (μm) | | Maximum Particle Size of Si Primary Crystal $D_{si}$ (μm) | | | |
|---|---|---|---|---|---|
| | | 200 < Dp ≦ 400 | 100 < Dp ≦ 200 | 50 < Dp ≦ 100 | Dp ≦ 50 |
| Alloy | P inoculation | | | | |
| A-17 | 0.008 wt. % | 5 | 4 | 3 | 2 |
| A-17 | no | 15 | 8 | 7 | 5 |
| A-20 | 0.008 wt. % | 6 | 5 | 3 | 2 |
| A-20 | no | 20 | 8 | 7 | 6 |
| A-25 | 0.008 wt. % | 8 | 5 | 3 | 2 |
| A-25 | no | 20 | 12 | 6 | 5 |
| B-25 | 0.012 wt. % | 7 | 4 | 3 | 2 |
| B-25 | no | 18 | 8 | 8 | 4 |
| C-25 | 0.007 wt. % | 7 | 4 | 2 | 2 |
| D-25 | 0.010 wt. % | 8 | 5 | 2 | 2 |
| E-25 | 0.015 wt. % | 9 | 7 | 5 | 3 |

Figure 4:
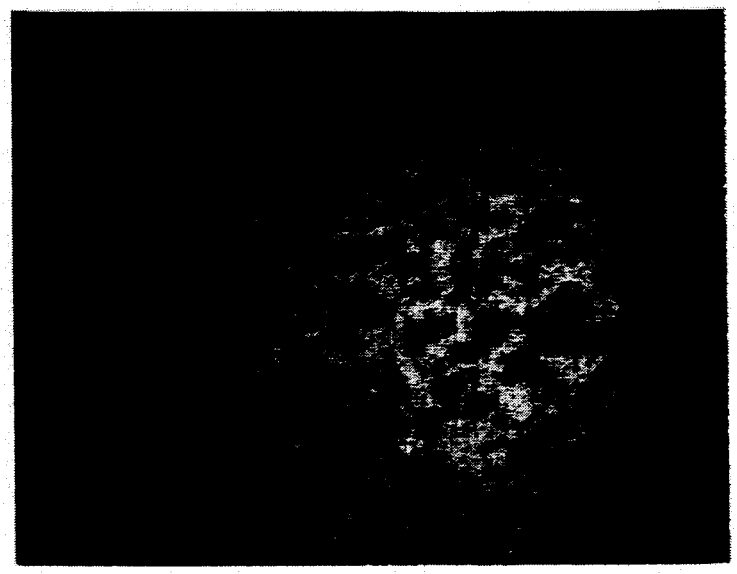
FIG. 4 is an optical microphotograph showing the metallographic structure of hyper-eutectic aluminum-25 wt. % silicon alloy powder obtained according to Example 3 and inoculated with Phosphorus, magnification: ×400.

FIG. 4 shows the metallographic structure of a hyper-eutectic aluminum-silicon alloy powder obtained by inoculating the aforementioned A-25 alloy with phosphorus. FIG. 4 was taken with an optical microphotograph of 400 magnifications.

Figure 5:
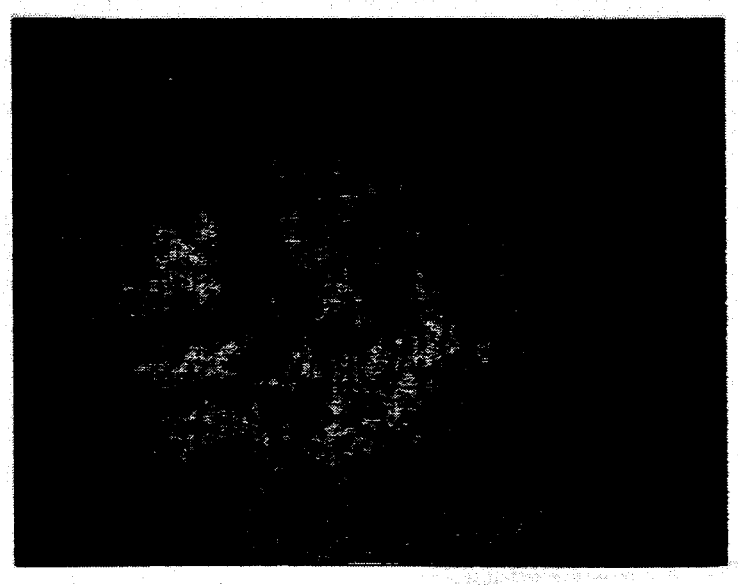
FIG. 5 is an optical microphotograph showing the metallographic structure of hyper-eutectic aluminum-25 wt. % silicon alloy powder obtained according to Example 3 but not inoculated with any Phosphorus, magnification: ×400.

FIG. 5 similarly shows the metallographic structure of hyper-eutectic aluminum-silicon alloy powder obtained by not inoculating the aforementioned alloy A-25 with phosphorus. Referring to FIGS. 4 and 5, dark gray portions show silicon primary crystals, pale gray portions show the matrix, and black portions show holes and filled resin parts.

The two types of powder samples obtained by inoculating the aforementioned A-25 alloys with phosphorus and by not inoculating phosphorus were pressure cold-formed without any with particle classification. These compacts were degassed and heated at a temperature of 450° C. for 30 minutes. The compacts were preheated at the same temperature, thereafter forged and formed at a surface pressure of 6 ton/cm², and subjected to a T6 heat treatment.

The mechanical properties of solidified bodies of the obtained powder samples were measured. The results of the measurements are shown in Table 6.

TABLE 6

| P Inoculation | Tensile Strength (MPa) | Elongation (%) |
|---|---|---|
| no | 400 | 0.5 |
| yes | 500 | 2.0 |

Figure 6:
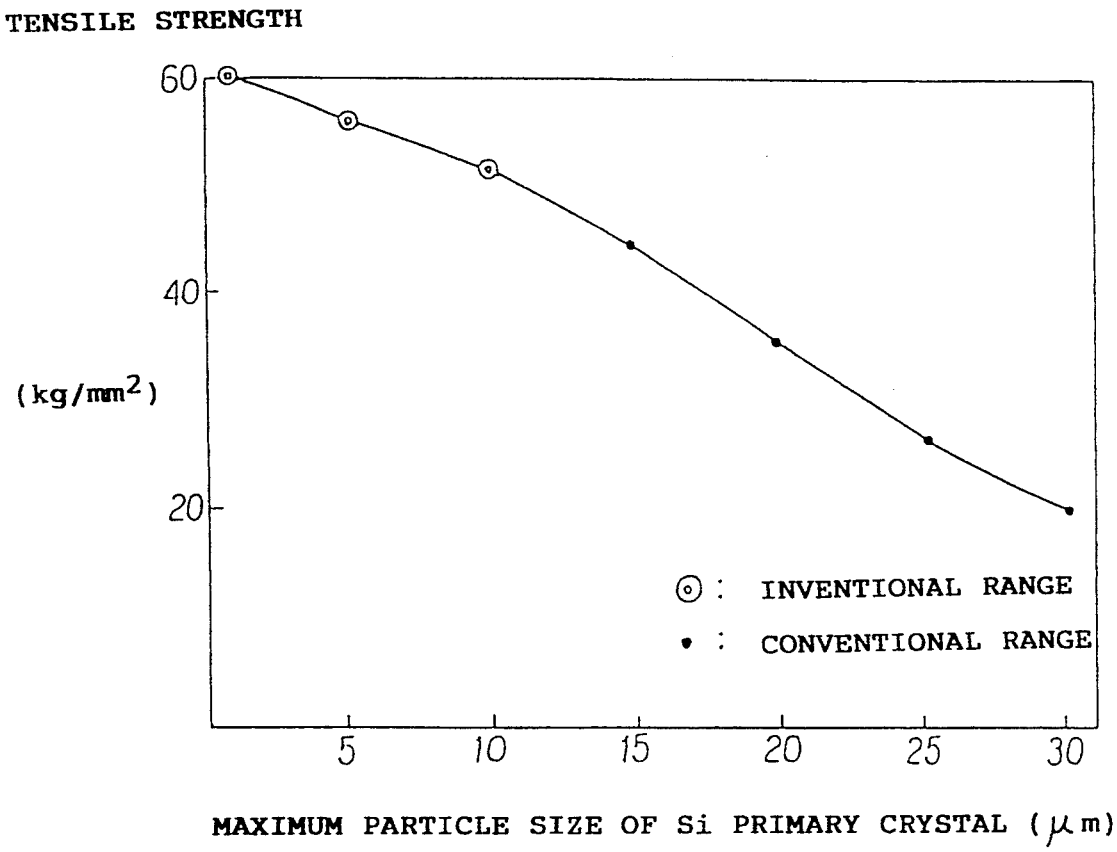
FIG. 6 is a graph showing the relationship between the maximum particle size of silicon primary crystals contained in the hyper-eutectic aluminum-25 wt. % silicon alloy powder according to Example 3 and tensile strength of consolidates obtained from the powder at room temperature.

The hyper-eutectic aluminum-silicon alloy powder samples obtained in relation to the aforementioned A-25 alloy were classified through the maximum particle sizes of silicon primary crystals $D_{si}$. The respective classified powder samples were measured to obtain their tensile strength by measuring or test solidified bodies of the respective powder samples prepared under same conditions as the above at the room temperature. The results of the measurement are shown in FIG. 6.

As understood from the aforementioned results, it is possible to control the sizes of the silicon primary crystals contained in the powder to be small in a very narrow range according to the present preparation method, whereby it is further possible to remarkably reduce rupture caused from starting points of coarse silicon crystals and to improve the mechanical strength of consolidates of the powder. By cutting the obtained consolidates, it is possible to stabilize chipping and wear of a cutting tool in a controlled manner.

As hereinabove described, a consolidate or hot worked product made of the present hyper-eutectic aluminum-silicon alloy powder has a very superior machinability and mechanical strength. Thus, it is usefully applied to making various parts for machine structural use. According to the present method of preparing the hyper-eutectic aluminum-silicon alloy powder, it is possible to refine and homogenize the primary crystal silicon contained in the hyper-eutectic aluminum-silicon alloy powder, thereby remarkably reducing the dependency of the particle size of the primary crystal silicon on the powder grain size as compared with the prior art. As a result, it is possible to make consolidates of powder which has improved mechanical properties as compared with the prior art. A high production yield is also obtained.

What is claimed is:

1. A hyper-eutectic aluminum-silicon alloy powder, comprising primary crystal silicon within the range of at least 12 percent by weight and at the most 50 percent by weight of said alloy powder, and phosphorus within the range of at least 0.0005 percent by weight and at the most 0.1 percent by weight of said alloy powder, said primary crystal silicon having a grain size of 10 μm at the most, said alloy powder having a particle size of 400 μm at the most, the remainder being aluminum and unavoidable impurities.

2. The hyper-eutectic aluminum-silicon alloy powder of claim 1, wherein said phosphorus is within the range of at least 0.0005 percent by weight and at the most 0.05 percent by weight of said alloy powder.

3. The hyper-eutectic aluminum-silicon alloy powder of claim 1, wherein said phosphorus is within the range of at least 0.02 percent by weight and at the most 0.1 percent by weight of said alloy powder.

4. The hyper-eutectic aluminum-silicon alloy powder of claim 1, further comprising at least 2.0 percent by weight and at the most 3.0 percent by weight of copper, at least 0.5 percent by weight and at the most 1.5 percent by weight of magnesium, at least 0.2 percent by weight and at the most 0.8 percent by weight of manganese, and at least 0.0005 percent by weight and at the most 0.05 percent by weight of phosphorus, the remainder being aluminum and unavoidable impurities.

5. A method of producing a hyper-eutectic aluminum-silicon alloy powder, comprising the following steps:

(a) melting aluminum-silicon alloy to form a melt, (b) preparing a refiner containing phosphorus as a crystal silicon refiner;

(c) adding said refiner to said melt to such an extent that said melt contains phosphorus within the range of 0.0005 percent by weight and at the most 0.1 percent by weight of said melt to form an aluminum-silicon alloy melt comprising 12 percent by weight to at the most 50 percent by weight of silicon, the remainder being aluminum and unavoidable impurities, (d) atomizing said aluminum-silicon alloy melt containing said phosphorus with one of air and an inert gas to form powder particles, and (e) classifying said powder particles by sifting through a respective screen, so that said alloy powder has a particle size of 400 μm at the most.

6. The method of claim 5, further comprising solidifying said aluminum-silicon alloy melt containing said phosphorus to form an ingot, and remelting said ingot prior to said atomizing and solidifying steps.

7. The method of claim 5, wherein said step of atomizing and solidifying said alloy melt is performed while maintaining said alloy melt at a temperature within the range of at least a level exceeding the liquidus temperature of said aluminum-silicon alloy by 100° C. and 1300° C. at the most.

8. The method of claim 5, wherein said step of atomizing and solidifying said alloy melt is performed after holding said melt at a temperature within the range of at least a level exceeding the liquidus temperature of said aluminum-silicon alloy by 100° C. and 1300° C. at the most.

9. The method of claim 5, wherein said powder particles are quench solidified prior to said classifying step.

10. A method of preparing a hyper-eutectic aluminum-silicon alloy powder, comprising the following steps:

(a) preparing a molten metal of a hyper-eutectic aluminum-silicon alloy containing phosphorus, (b) preparing a hyper-eutectic aluminum-silicon alloy powder rapid solidified by atomizing said molten metal with air to form powder particles, and (c) classifying said powder particles by sifting through a respective screen so that said alloy powder has a particle size of 400 μm at the most.

11. The method of claim 10, wherein said step of sifting selects a powder particle size of 200 μm at the most.

12. The method of claim 10, wherein said step of sifting selects a powder particle size of 100 μm at the most.

13. The method of claim 10, wherein said step of sifting selects a powder particle size of 50 μm at the most.

14. The method of claim 10, wherein said powder particles are quench solidified prior to said classifying step.

* * * * *

UNITED STATES PATENT AND TRADEMARK OFFICE

CERTIFICATE OF CORRECTION

PATENT NO. : 5,366,691

DATED : Nov. 22, 1994

INVENTOR(S) : Yoshinobu Takeda et al.

It is certified that error appears in the above-identified patent and that said Letters Patent is hereby corrected as shown below:

Column 2, line 34, delete ";",

Column 7, line 57, before "cutting" insert --dry--,

Column 10, line 10, after "inoculating" insert --with--, line 14, replace "and" by --or--, line 31, replace "test" by --testing--, line 33, after "under" insert --the--.

Signed and Sealed this

Seventeenth Day of January, 1995

Bruce Lehman

*Attest:*

BRUCE LEHMAN

*Attesting Officer*

*Commissioner of Patents and Trademarks*